US008192336B2

(12) United States Patent
Jacob

(10) Patent No.: US 8,192,336 B2
(45) Date of Patent: Jun. 5, 2012

(54) COMPRESSIVE DEVICE AND CARRYING COMPARTMENT FOR USE DURING EXERCISE

(76) Inventor: William J. Jacob, Kansas City, MO (US)

( * ) Notice: Subject to any disclaimer, the term of this patent is extended or adjusted under 35 U.S.C. 154(b) by 411 days.

(21) Appl. No.: 11/751,051

(22) Filed: May 21, 2007

(65) Prior Publication Data

US 2008/0103032 A1 May 1, 2008

(51) Int. Cl.
*A63B 21/02* (2006.01)

(52) U.S. Cl. ..... 482/124; 482/121

(58) Field of Classification Search ..... 482/121–126, 482/74; 2/107

See application file for complete search history.

(56) References Cited

U.S. PATENT DOCUMENTS

| | | | | |
|---|---|---|---|---|
| 5,129,647 | A * | 7/1992 | Castellanos | 482/124 |
| 5,205,814 | A * | 4/1993 | Lundrigan et al. | 602/19 |
| D347,667 | S * | 6/1994 | Giacalone et al. | D21/692 |
| 6,322,482 | B1 * | 11/2001 | Kim | 482/124 |
| 6,331,170 | B1 * | 12/2001 | Ordway | 602/19 |
| 6,645,128 | B1 * | 11/2003 | Hur | 482/124 |
| 6,711,750 | B1 * | 3/2004 | Yoo | 2/338 |
| 2008/0190980 | A1 * | 8/2008 | Overton | 224/664 |

* cited by examiner

*Primary Examiner* — Fenn Mathew

(57) ABSTRACT

A compressive device and carrying compartment for focusing a compressive force at the general lateral areas of a human waist, and securing at least one object in a generally fixed position relative to the waist, includes a longitudinally elastic belt having lateral area engaging pads, and further including a bag defining an interior space and laterally apposite slot openings, wherein the bag and belt are cooperatively configured such that the belt passes within the space and the compressive force also works to biasly retain the objects in the fixed position.

17 Claims, 6 Drawing Sheets

COMPRESSIVE DEVICE AND CARRYING COMPARTMENT FOR USE DURING EXERCISE

BACKGROUND OF THE INVENTION

1. Technical Field

The present invention relates to exercise apparel and elastic devices for engaging the abdominal area of a human user. More particularly, the present invention relates to a compression device including an elastic belt configured to focus therapeutic compression at the sides of the user and a bag coupled to the belt. The belt and bag are cooperatively configured to store and secure a plurality of objects in a generally fixed position.

2. Discussion of Prior Art

Exercise is commonly performed to effect physiological change in humans; for example, cosmetic change to the anatomy or increased overall wellness of the performer is often desired. A pervasive and long-practiced exercise is jogging (or distance running). Whether outdoors or indoors upon a track or treadmill, jogging is typically performed with minimal clothing and carrying capability in order to reduce weight. Where incidental objects, such as keys, wallets/money clips, cellular telephones, or other electronic devices are desired to be retained by the performer, he or she must either don clothing having pockets or a small carrying bag, or be willing to hold the items for the duration of the exercise. One type of bag is donned around the waist of the performer and includes a belt.

These methods of securing objects during jogging, however, are problematic. Pockets and conventional bags, for example, do not fixedly secure the items. During the sudden acceleration and deceleration associated therewith, items in pockets and bags are jostled, float and crash along with the performer. As a result, sensitive electronic equipment may become temporarily or permanently disabled, and keys may present an audible nuisance. Manually holding the items by the performer is also undesired for apparent reasons, including discomfort and stress.

Another concern associated with conventional exercise is the inability to effect cosmetic change at the lateral areas of the mid-section. These areas, also known as "love-handles" are prone to fat retention, but have proven difficult to treat. Few exercises, including jogging, effectively target these areas.

SUMMARY OF THE INVENTION

Responsive to these problems and concerns, the present invention presents a compressive device configured to effectively treat the lateral sides of a human user, and a carrying compartment configured to secure objects while exercising. Among other things, the invention is useful for eliminating nuisances created by totting loose objects in pockets and conventional bags or by having to manually carry objects during exercises, including jogging. By securing the objects in a generally fixed position relative to the user, the invention is further useful for improving the performance of some electronic devices, including digital music players. The invention efficiently utilizes a single elastic force for applying the compressive lateral treatment and securing the objects.

In general, a first aspect of the invention concerns a compressive device adapted for use with a human waist defining a first circumference, and for focusing a compressive force to the general lateral areas of the waist. The device includes first and second spaced apart elastic pads each presenting a first height, and a longitudinally elastic belt interconnecting the pads. The belt presents a second height substantially less than the first height, and defines a continuous wall having an un-stretched circumference less than and a maximum stretched circumference greater than the first circumference. The belt and pads are cooperatively configured such that the pads are adjacent the areas, when the device is donned.

A second aspect of the invention concerns a carrying compartment also adapted for use with the waist, and for securing at least one object in a generally fixed position relative to the waist. The compartment is interfitted with the elastic belt, and includes a bag transitionable between open and closed conditions. The bag defines an interior space when in the closed condition, and is configured to retain the plurality of objects within the space. The belt and bag are cooperatively configured such that at least a portion of the belt is able to pass through the interior space and secure the objects in a generally fixed position relative to the waist.

Yet further aspects, embodiments, and advantages of the present invention, including belt and pad dimensions, preferred material composition, rigid or concave pad members, adjustable fastening mechanisms, adjustably positionable bag stirrups, and bag eyelets will be apparent from the following detailed description of the preferred embodiment(s) and the accompanying drawing figures.

BRIEF DESCRIPTION OF DRAWINGS

Preferred embodiments of the invention are described in detail below with reference to the attached drawing figures, wherein.

Figure 7:
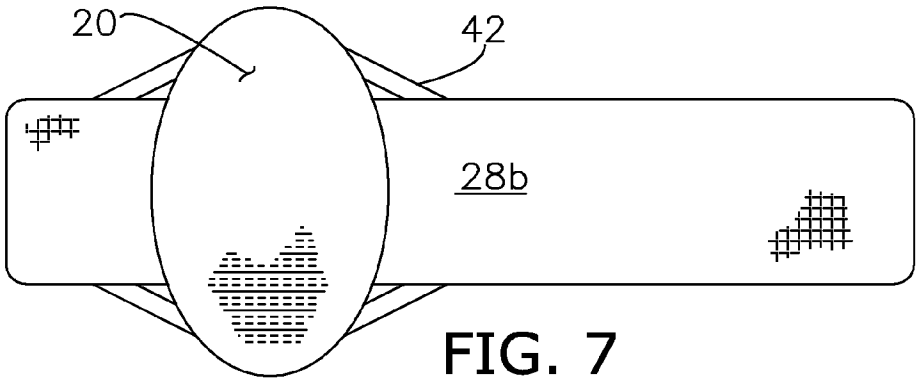
Figure 8:
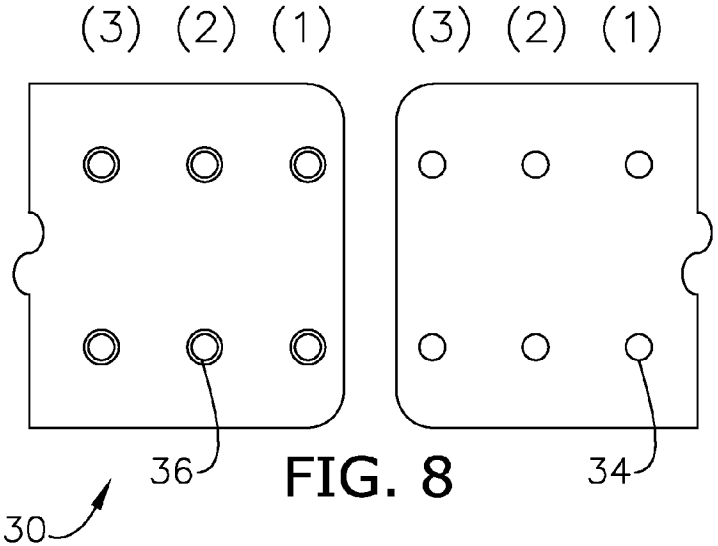
Figure 10:
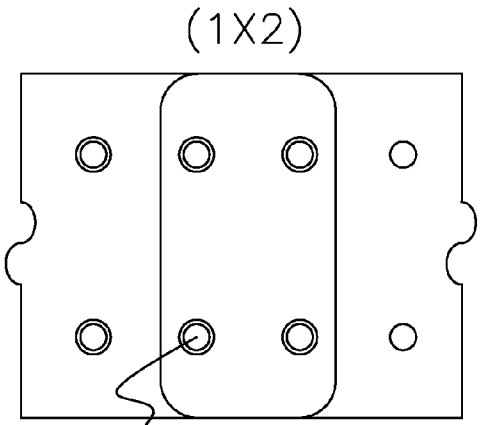
Figure 9:
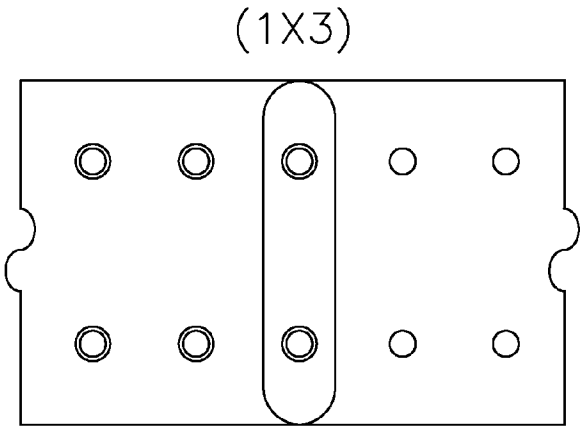
Figure 11:
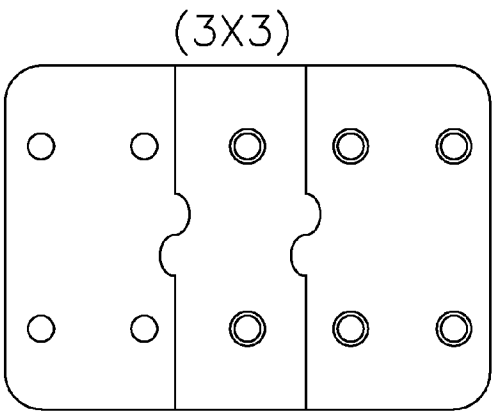
Figure 12:
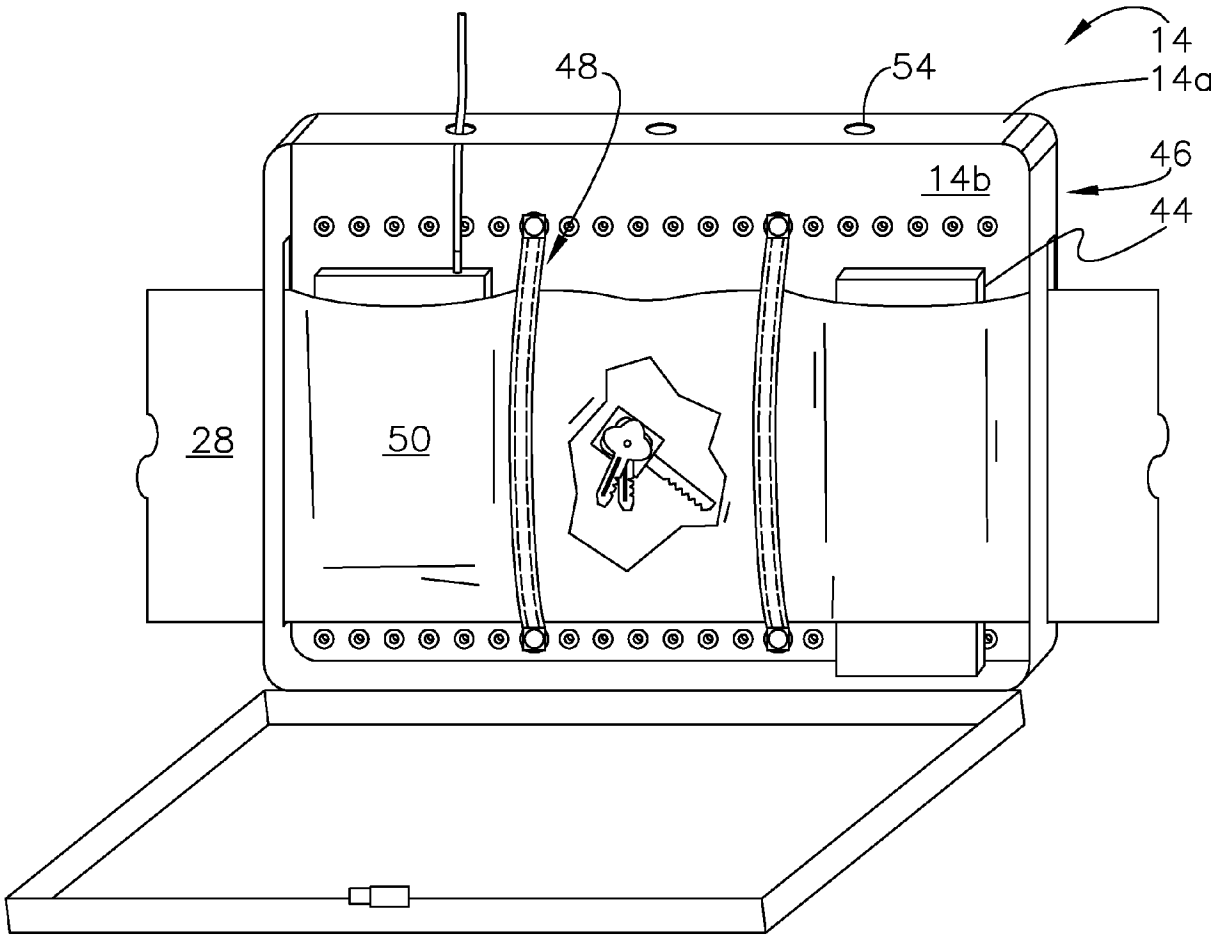
Figure 14:
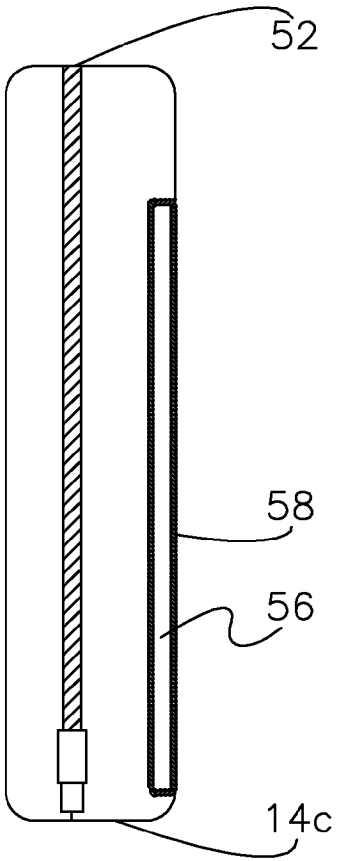
Figure 13:
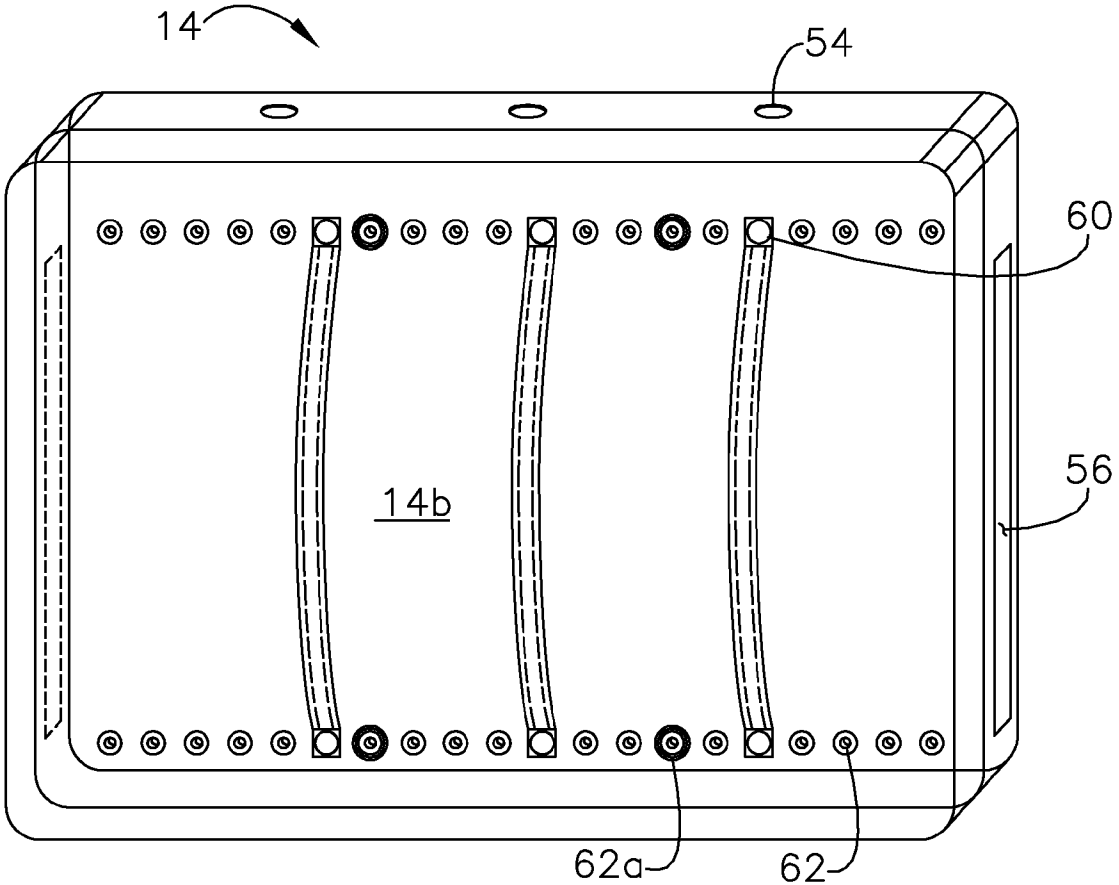

FIG. **6*a*** is a side elevation view of a pad having a concave member in accordance with a preferred embodiment of the present invention;

FIG. 7 is an elevation view of the interior surface of a belt part, particularly illustrating a textured inner belt surface and a wool felt overlay adjacent the pad;

FIG. 8 is a segmental view of the distal ends of a belt having a plurality of six snap fasteners presenting three columns, particularly illustrating and labeling pluralities of male prong and female receptacle columns;

FIG. 9 is a segmental view of the ends shown in FIG. 8, particularly illustrating the ends in a 1×3 fastened condition;

FIG. 10 is a segmental view of the ends shown in FIG. 8, particularly illustrating the ends in a 1×2 fastened condition;

FIG. 11 is a segmental view of the ends shown in FIG. 8, particularly illustrating the ends in a 3×3 fastened condition;

FIG. 12 is a perspective view of a portion of a belt and a bag in accordance with a preferred embodiment of the present invention, particularly illustrating the bag in an open condition, and having a plurality of two adjustably positioned stirrups, the belt portion passed through slot and stirrup openings so as to form a plurality of three pockets, three objects being biasly retained within the pockets, and a plurality of eyelets above the pockets;

FIG. 13 is a wire-frame perspective view of the bag shown in FIG. 12 in a closed condition and having a plurality of three stirrups; and FIG. 14 is a side elevation view of a bag in accordance with a preferred embodiment of the present invention, particularly illustrating a zipper closing mechanism, and a slot opening having reinforced edging.

DETAILED DESCRIPTION OF THE INVENTION

Figure 2:
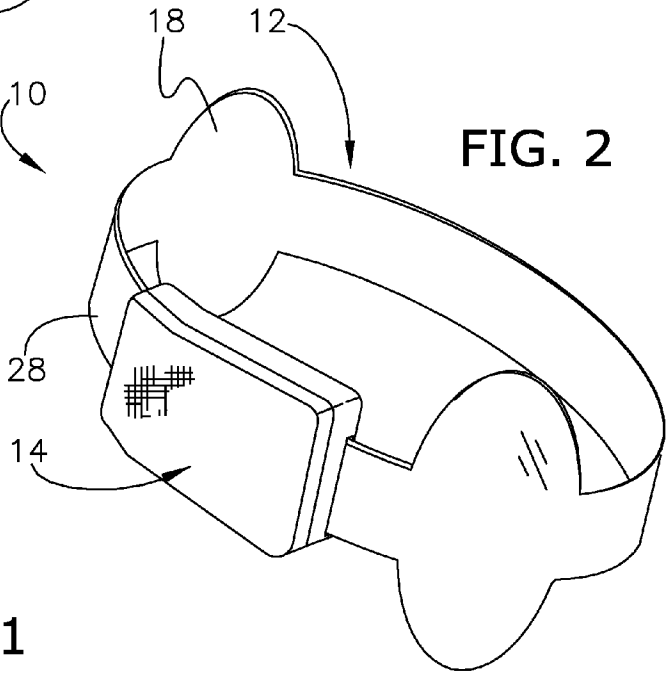
FIG. 2 is a perspective view of the device and compartment shown in FIG. 1.
Figure 1:
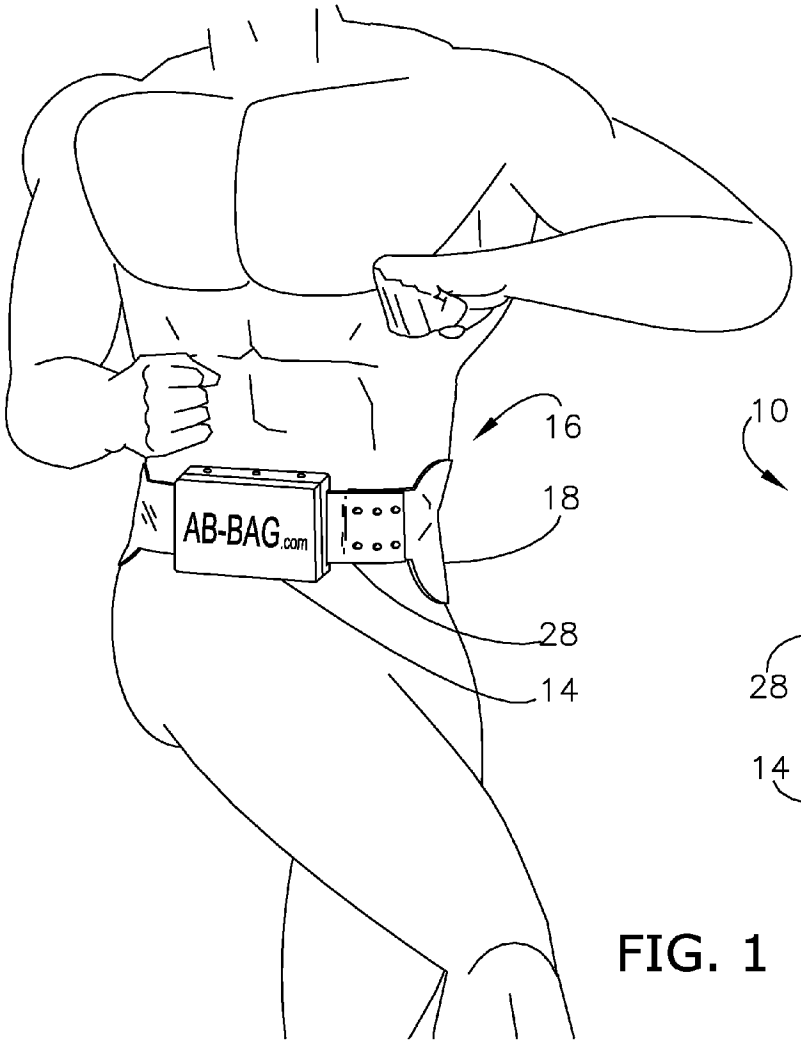
FIG. 1 is a perspective view of a compressive device and carrying compartment in accordance with a preferred embodiment of the present invention, being donned about the waist of a human user.

The present invention concerns a combination unit 10 that presents a novel compressive device 12 and carrying compartment 14. As shown in FIG. 1, the unit 10 is adapted for use with a human waist 16 that defines a waist circumference. For the intents and purposes herein, the waist 16 is centered and the circumference measured across the naval of male users and directly below the naval of female users. It is appreciated that the lateral areas of these locations present the targeted problematic "love-handle" zones, which the invention is intended to treat. The unit 10 is configured for use during and to facilitate exercise activities, including jogging, and more preferably, in association with a regimented diet and exercise plan; but may be used in other modes of operation.

I. Compressive Device

Unlike conventional abdominal sleeves and supports (not shown), which compress the mid-section of a user indiscriminately, the compressive device 12 is designed to focus the compressive force at the problematic lateral areas. More particularly, as shown in FIGS. 2 through 6*a*, the device 12 includes two preferably identical pads 18 for applying the force evenly over a larger surface. Each pad 18 presents a pad height and width sufficient to predominantly overlay the targeted areas. In the illustrated embodiment, the pads 18 present elliptical shapes having a vertical major axis length of 7 inches (i.e., 17.75 cm), and a minor axis of 4.5 inches (i.e., 11.4 cm). It is well within the ambit of the invention, however, for the pads 18 to present other shapes such as polygons and circles.

The pads 18 are preferably elastic so as to conform to the contours of the areas and to further generate the compressive force. As such, the pads may be formed of stretchable material such as Neoprene™, Spandex™, an elastic woven fabric, or a combination thereof. The preferred pads 18 are generally non-thermoconductive, so as to trap body-produced heat within the zones; and may therefore include a layer 20 of thermally non-conductive material, such as wool felt or neoprene, adjacent the waist 16 (FIG. 7). To provide more malleability and compressibility, the pads 18 may be perforated and/or vertically corrugated.

Figure 6:
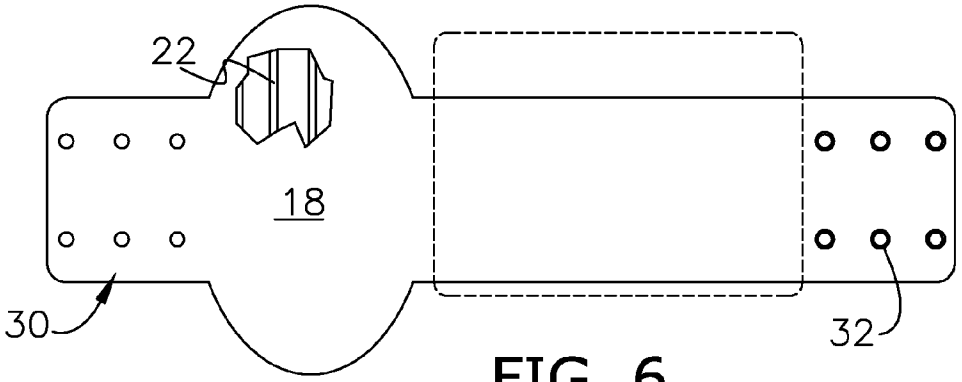
FIG. 6 is an elevation view of a single belt part as shown in FIG. 4, particularly illustrating a side compression pad having rigid members in accordance with a preferred embodiment of the present invention.

In a preferred embodiment, the pads 18 include at least one rigid elongated member 22 for added stiffness about horizontal axis. For example, as shown in FIG. 6, at least one solid flat rod formed of rigidly flexible material, such as aluminum or a hard plastic, may be vertically oriented. In this configuration the pads 18 are able to be stretched and flexed laterally, so as to be able to envelop the waist 16, but are resistant to vertical flexure to more efficiently focus the compressive force.

Figure 6A:
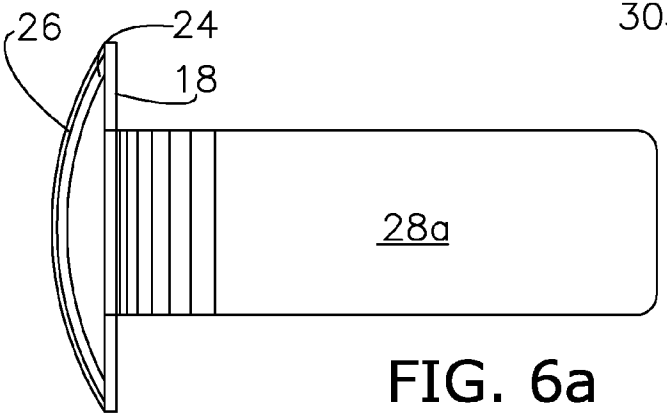

In an alternative embodiment, the pads 18 may include a concave disk member 24 (FIG. 6*a*). The concave member 24 defines an interior space that is positionable adjacent the waist 16 and configured to resist outward vertical and outward lateral bending, but allow inward bending in both directions. Both the elongated and concave members 22,24 may be overlaid by an exterior unit layer 26, such as a patterned fabric, that covers the entire device 12. It is appreciated in this configuration, however, that where the disk 24 is encapsulated within the pad 18, and is not free to float, the pad 18 is not able to stretch.

The device 12 further includes a belt 28 for interconnecting the pads 18 and generating the compressive force. The belt 28 and pads 18 are cooperatively configured such that the pads 18 are positioned adjacent the targeted lateral areas of the waist 16 (FIG. 1). Unlike conventional abdominal compressive sleeves, the belt 28 presents a height substantially less than (i.e., less than 75 percent of) the pad height, so as to provide increased comfort to the user. For example, it is appreciated that this configuration enables the user to perform sit-ups, stomach crunches, and other exercises involving bending at the waist, whereas the afore-mentioned abdominal sleeves may not. In the illustrated embodiment the belt 28 presents a height of 3.5 inches (i.e., 8.9 cm).

Finally, the belt 28 defines a continuous wall (FIG. 2) having a circumference configured to retain the device 12 at a fixed elevation relative to the user, and generate the compressive force. To facilitate removal and placement of the belt 28 detachable distal ends and a fastening mechanism 30 are preferably presented (FIGS. 3 through 6*a*). The preferred mechanism 30 is adjustable so that the circumference of the belt 28 can be changed based upon the tensile strength of the material, and the waist circumference and comfort level of the user. For example, and as best shown in FIGS. 3, 4 and 8 through 11, the belt 28 may include at least one, and more preferably a plurality of conventional snap fasteners 32 comprising a male prong member 34 and a female receptacle 36.

The preferred belt 28 is elastic, and presents an un-stretched circumference less than and a maximum stretched circumference greater than the waist circumference. As such, the belt 28 preferably consists of a suitably stretchable material, and more preferably a stretchable material that increases the friction force between the waist 16 and belt 28 when wet. For example, a suitable material for use with the present invention is Neoprene™. To further increase friction between the waist 16 and belt 28, the waist engaging surface 28*b* of the belt preferably presents a textured surface (FIG. 7). To further facilitate comfort, however, the belt 28 may consist of a softer and more flexible material such as spandex, while the pads 18 are formed of more rigid material, such as thick (e.g.>3 mm) Neoprene™.

As previously mentioned the pads 18 and belt 28 may be formed of a woven fabric material. In a preferred embodiment, the material may consist generally of core-spun yarn and elastic filaments laid in at least every fourth course of knitted yarn. The core-spun yarn further comprises a spandex core and fiber sheathing. The preferred sheathing comprises slivers of blended channeled polyester and antimicrobial acetate fibers, and is preferably latex free. The channels of the polyester fiber serve to pull heat generated moisture form the body to the outer layer of the material which has an increased surface area relative to the skin, thereby enhancing evaporation. One suitable channeled polyester fiber is also available from DuPont under the designation "COOLMAX". The antimicrobial fiber serves to control bacteria-related odors and stains and create more hygienic and comfortable conditions. A suitable antimicrobial acetate fiber is available under the designation "MICROSAFE" from Celanese Acetate of Rockhill, S.C. One acceptable brand of spandex to be used for the core is 140 denier LYCRA brand spandex available from E.I. DuPont Nemours & Co., Inc., of Wilmington, Del. More preferably, the core-spun yarn comprises about 95% fiber sheathing, and 5% spandex, and the fiber sheathing comprises about 85% polyester and 15% antimicrobial fiber.

Alternatively, the belt 28 may consist of a conventional ACE™ Elastic Bandage that is reduced to lengths in accordance with the invention, and more preferably a ACE™ Elastic Bandage having a Velcro™ strip fastener pre-existingly fastened thereto. In this configuration, novel pads 18 and compartment 14 are removeably interfitted with the pre-existing and widely available belt material. To that end, the pads 18 may present vertical receiving slots (not shown) that enable the belt 28 to pass therethrough or further Velcro™ strips (also not shown) that allow the pads 18 to attach to the belt 28.

Figure 3:
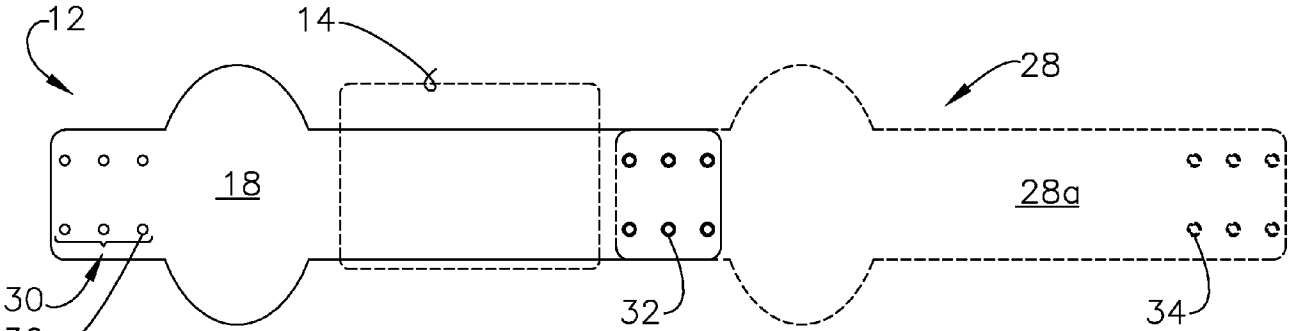
FIG. 3 is an elevation view of a two-part belt in accordance with a preferred embodiment of the invention, particularly illustrating multi-snap adjustable fastening mechanisms and a preferred bag position shown in hidden line.
Figure 4:
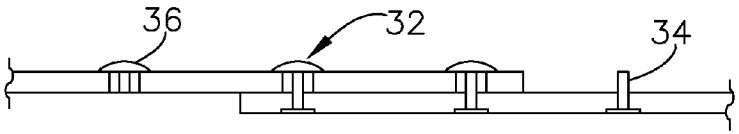
FIG. 4 is a segmental side view of a two-part belt, particularly illustrating a plurality of snap fasteners in clasped and un-clasped conditions.
Figure 5:
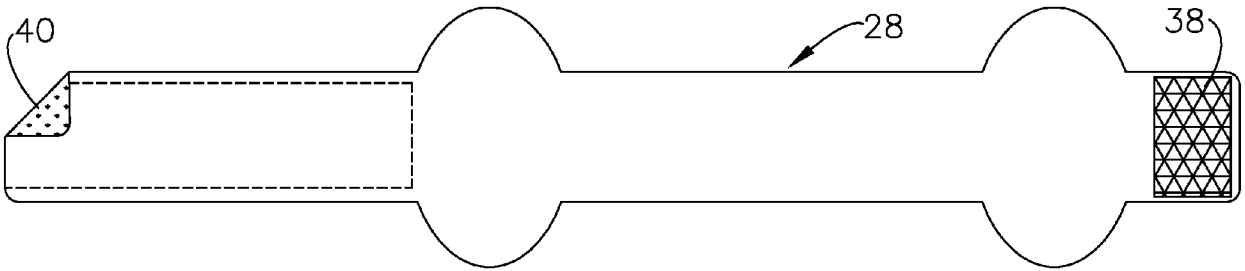
FIG. 5 is an elevation view of a singular belt in accordance with a preferred embodiment of the present invention, particularly illustrating a Velcro fastening mechanism adjacent first and second distal ends.

As shown in FIGS. 3 and 5, exemplary dimensions for a two-part belt 28 include a part length of 18 inches (i.e., 45.75 cm). Where the first column is spaced 0.25 inches (i.e., 0.635 cm) from the distal end and the columns are spaced 1 inch (i.e., 2.54 cm) o.c., the parts present a final belt circumference having a length of 31 inches (i.e., 78.7 cm), when both mechanisms 30 are fully fastened, as shown in FIG. 3. This fastened condition is denominated as "1×1" in accordance with the column labeling shown in FIG. 8. Finally, the unit 10 may be scaled to present various sizes (e.g., S, M, L, XL) as is necessary to treat a targeted market. In FIG. 6, the belt length is shortened to 17.25 inches (i.e., 43.8 cm), which yields a 1×1 fastened circumference of 29.5 inches (i.e., 74.9 cm).

As shown in FIGS. 9 through 11, the collimated multi-snap mechanism 30 yields variable belt circumference lengths. A "1×3" fastened condition (FIG. 9) at both mechanisms 30 yields a belt circumference of 35 inches (i.e., 88.9 cm) on an 18 inch part belt; a "1×2" condition (FIG. 10) yields a circumference of 33 inches (i.e., 83.82 cm); and a "3×3" maximum overlap condition (FIG. 11) yields a circumference of 27 inches (i.e., 68.58 cm), etc. Adjusting only one mechanism 30 yields further intermediate adjustment increments useful for properly positioning the pads 18.

Alternatively, the mechanism 30 may present a gradually adjustable mechanism having an infinite number of adjustable conditions. For example, and as previously mentioned, hook and loop Velcro™ strips 38,40 may be attached to the belt 28 on opposite surfaces and adjacent the distal ends (FIG. 5). More preferably, the loop strip 40 extends the entire length of the long leg 28*a* of the belt, so as to practically present a one-size-fits-all adjustable belt 28.

Finally, and as shown in FIG. 7, the preferred device 12 further includes a plurality of four elastic contour bands 42 that diagonally extend from the upper and lowermost sectors, and on both sides of the pads 18. It is appreciated that the diagonal vectors of the counter bands 42 cause the pads 18 to more accurately envelop and grab the lateral areas, when the device 12 is donned. The bands 42 preferably consist of the same material as the belt 28 so that the forces acting upon the pads 18 are generally balanced and uniform.

II. Carrying Compartment

Turning to FIG. 12, the novel carrying compartment 14 is detachably interfitted with the belt 28, and configured to secure at least one, and more preferably a plurality of objects 44 in a generally fixed position relative to the waist 16. That is to say, the belt 28 and compartment 14 are cooperatively configured such that the objects 44 are fixed relative to the user even during exercise. It is appreciated that the compartment 14 may be utilized with elastic belts other than the device 12 (as such the term "carrying compartment" may include the provision of an elastic belt); however, the unit 10 as described herein presents the preferred embodiment of the invention.

The compartment 14 includes a bag 46 and preferably at least one stirrup 48 for forming a plurality of pockets 50. The bag 46 is transitionable between open and closed conditions (compare FIGS. 12 and 13), and defines a generally interior space when in the closed condition. More particularly, the bag 46 may include a conventional zipper 52 (FIG. 14) that enables the user to open and close the bag 46.

An exemplary bag shape is shown in the illustrated embodiment presenting a rectangular cube having front, back, top, bottom, and lateral sides, wherein the back side 14*a* is the side adjacent the waist 16; however, other bag configurations could be utilized. Correlative to the previously mentioned belt and pad dimensions the illustrated bag 46 preferably presents a height of 5 inches (i.e., 12.7 cm) and a length of 7 inches (i.e., 17.78 cm), and a depth of 2 inches (i.e., 5.1 cm). It is appreciated that these dimensions are sufficient to carry the typical objects that often accompany an exercise performer, such as, for example, wallets/money clips, cellular telecommunication or digital media devices, and keys. To facilitate usage of certain devices by the performer, the top side 14*a* preferably defines a plurality of eyelets 54 (FIG. 12) above at least a portion of the pockets 50.

The belt 28 and bag 46 are cooperatively configured such that at least a portion of the belt 28 is able to pass through the interior space and cooperatively secure the objects 44 in the generally fixed position. For example, in the illustrated embodiment the lateral sides of the bag 46 define opposite slot openings 56 (FIG. 13). The openings 56 each present a slot height greater than the belt height and a width slightly greater than the belt width including the fastening mechanism 30. As best shown in FIG. 14, the openings 56 are positioned generally adjacent the back side 14*b*, so that the belt 28 and back side 14*b* form generally superjacent layers within the interior space. Further, the openings 56 are preferably positioned at or near (within 1 inch of) the bottom side 14*c*, so that the belt 28, back side 14*b*, and bottom side 14*c* cooperatively define each pocket 50. Where elastic, the belt 28 produces a biasing force against the objects 44 and towards the back side 14*b*, which holds the objects 44 in place. It is appreciated that the same compressive force used to treat the lateral areas is also used to engage and secure the objects 44 in the generally fixed position. Finally, the slot openings 56 preferably include reinforced edging 58 (FIG. 14) to interface with the belt 28 under stressed conditions.

Each stirrup 48 is positioned within the interior space and connected to the back side 14*b*, so as to cooperatively form a stirrup opening, and the stirrup opening is configured so as to allow the belt 28 to snugly pass therethrough. As a result, the belt 28, back side 14*b*, bottom side 14*c*, and stirrup 46 cooperatively define the plurality of pockets 50 within the interior space (FIGS. 12 and 13). More preferably, the stirrups 48 are removable and adjustable. In the illustrated embodiment, leather straps having male snap prongs 60 attached to both distal ends present the stirrups 48; the back side 14*b* of the bag includes pluralities of female receptacles 62 defining upper and lower linear tracks; the stirrups 48 are configured and the tracks are spaced so as to tightly receive the belt 28; and the stirrup locations may be adjusted by repositioning the male prongs 60 to a different set of vertically aligned receptacles 62 (compare FIGS. 12 and 13). Marker receptacles 62*a* are preferably provided and evenly spaced along the tracks to facilitate proper alignment. Finally, as shown in FIGS. 12 and 13, differing pluralities of stirrups 48 may be utilized to create differing pluralities of pockets 50, and pockets 50 having differing lateral dimensions.

The preferred forms of the invention described above are to be used as illustration only, and should not be utilized in a limiting sense in interpreting the scope of the present invention. Obvious modifications to the exemplary embodiments and modes of operation, as set forth herein, could be readily made by those skilled in the art without departing from the spirit of the present invention. I hereby state my intent to rely on the Doctrine of Equivalents to determine and assess the reasonably fair scope of the present invention as it pertains to any apparatus, assembly, or method not materially departing from but outside the literal scope of the invention as set forth in the following claims.

I claim:

1. A compressive device adapted for use with a human waist defining a first circumference, and for focusing a compressive force and thermal barrier at the general lateral or oblique areas of the waist, said device comprising:

an elastic belt presenting a first maximum height, and defining a continuous wall having an un-stretched circumference less than and a stretched circumference greater than the first circumference; and first and second spaced apart pads each presenting a second maximum height not less than thrice the first height, and generally convex profiles emanating from the belt, and comprising material having a predetermined thermal conductivity rate, said belt and pads being cooperatively configured so as to define first and second belts sections, and having length ratios such that the pads are generally diametrically disposed, so as to be positioned generally adjacent, and apply the force only to the areas, when the device is donned.

2. The device as claimed in claim 1, wherein each of said pads presents an elliptical un-stretched shape having a generally vertical major axis of length equal to the first height.

3. The device as claimed in claim 1, wherein each of said pads includes at least one rigid member flexible configured to resist vertical bending and allow lateral flexure.

4. The device as claimed in claim 1, wherein each of said pads includes a concave member defining an interior space positionable adjacent the waist and configured to resist vertical and lateral bending.

5. The device as claimed in claim 1, wherein the pads and belt are formed of a material selected from the group consisting essentially of neoprene, spandex or an elastic woven fabric.

6. The device as claimed in claim 5, wherein said belt is formed of neoprene, presents an exterior surface and waist engaging surface, and the waist engaging surface is textured, so as to increase friction between the waist and belt.

7. The device as claimed in claim 1, wherein the pads are formed of at least a first material, and the belt is formed of a second material more elastic than the first material.

8. The device as claimed in claim 7, wherein the first material is generally non-thermoconductive.

9. The device as claimed in claim 8, wherein the first material is wool felt.

10. The device as claimed in claim 1, wherein the belt presents first and second loose distal ends, includes an adjustable fastening mechanism, and is adjustably fastenable at or near the distal ends, so as to present longitudinal adjustability.

11. The device as claimed in claim 10, wherein the fastening mechanism includes at least one two-part snap, and the snap includes a male engaging prong at or near the first end and a female receiving receptacle at or near the second end.

12. The device as claimed in claim 11, wherein the mechanism includes a plurality of snaps, and the snaps present a plurality of spaced columns, so as to present an incrementally adjustable un-stretched circumference.

13. The device as claimed in claim 10, wherein the mechanism includes a Velcro-strip at or near the first or second end, so as to present a gradually adjustable un-stretched circumference.

14. The device as claimed in claim 10, wherein the belt includes a plurality of adjustably interconnected parts, and a second adjustable fastening mechanism intermediate the parts, so as to present compound longitudinal adjustability.

15. A carrying compartment adapted for use with a human waist defining a first circumference, and for securing at least one object in a generally fixed position relative to the waist of a user, said compartment comprising:

a longitudinally elastic belt defining a continuous wall having an un-stretched circumference less than and a maximum stretched circumference greater than the first circumference, so as to apply a compressive force to the waist when the compartment is donned by the user; and a bag defining an interior space configured to retain said at least one object, said belt and bag being cooperatively configured such that at least a portion of the belt is able to pass through-the interior space, said at least one object is intermediately positionable between the belt and waist, and the portion of the belt engages said at least one object, so as to further apply the compressive force to the object and bag, thereby securing the object in a generally fixed position relative to the waist when the compartment is donned by the user, wherein the belt defines a first height, and the bag includes a back side, and lateral sides defining opposite slot openings, the openings each present a slot height greater than the first height, so as to receive the belt, and the openings are positioned generally adjacent the back side so that the belt and back side form generally superjacent layers within the interior space, wherein the bag further includes a bottom side, the openings are further positioned generally adjacent the bottom side, and the belt, back side, and bottom side cooperatively define at least one pocket within the interior space, wherein the belt produces a biasing force towards the back side, when the compartment is donned, wherein the bag further includes at least one stirrup positionable within the space and connected to the back side, so as to cooperatively form a stirrup opening, the stirrup is configured so as to allow the belt to snugly pass through the stirrup opening, so that the belt, back side, bottom side, and stirrup cooperatively define a plurality of pockets within the interior space, when the compartment is donned.

16. The compartment as claimed in claim 15, wherein the bag further includes a top side, the slot openings present reinforced edging, a plurality of stirrups are adjustably interconnectable to the back side, so as to be able to present differing plurality of pockets having differing lateral dimensions, and the top side defines a plurality of eyelets above at least a portion of the pockets.

17. A unit adapted for use with a human waist defining a first circumference, for focusing a compressive force at the general lateral or oblique areas of the waist, and for securing at least one object in a generally fixed position relative to the waist, said unit comprising:

first and second spaced apart pads each presenting a first maximum height and generally convex profiles emanating from the belt;

a longitudinal belt interconnecting the pads, presenting a second height not more than thirty-three percent of the first height, and defining a continuous wall having an un-stretched circumference less than and a maximum circumference greater than the first circumference, so as to apply a compressive force to the waist when the unit is donned; and a bag manually transitionable between open and closed conditions, defining an interior space when in the closed condition, and configured to retain differing pluralities of objects presenting differing shapes, sizes, and dimensions, said belt and pads being cooperatively configured such that the pads define first and second belt sections having length ratio not less than two to three, so as to be positioned generally adjacent only the areas when the unit is donned, said belt and/or bag being configured to apply at least a portion of the force to a selected at least one of a plurality of objects of differing shapes, sizes, and dimensions and space said selected at least one object from the waist, so as to secure said selected at least one object in a generally fixed position relative thereto.

* * * * *